US005213920A

United States Patent [19]

Coppens et al.

[11] Patent Number: 5,213,920

[45] Date of Patent: May 25, 1993

[54] METHOD FOR OBTAINING LITOGRAPHIC PRINTING PLATES BY ELECTROPHOTOGRAPHIC IMAGING

[75] Inventors: Paul J. Coppens, Turnhout; Ludovicus H. Vervloet, Kessel; Serge M. Tavernier, Lint; Paul F. Sterckx, Begijnendijk, all of Belgium

[73] Assignee: AGFA-Gevaert N.V., Mortsel, Belgium

[21] Appl. No.: 798,004

[22] Filed: Nov. 26, 1991

[30] Foreign Application Priority Data

Nov. 30, 1990 [EP] European Pat. Off. ..... 90203165

[51] Int. Cl.[5] ..... G03G 13/26

[52] U.S. Cl. ..... 430/49; 430/144

[58] Field of Search ..... 101/426; 430/49, 144, 430/162

[56] References Cited

U.S. PATENT DOCUMENTS 3,987,728 10/1976 Miller et al. ..... 430/49

5,028,512 7/1991 Nagatani et al. ..... 430/49

*Primary Examiner*—John Goodrow

*Attorney, Agent, or Firm*—William J. Daniel

[57] ABSTRACT

The present disclosure relates to an electrophotographic method of obtaining a lithographic printing plate comprising the step of transferring a toner image from a toner image bearing member to a toner receiving plate, said toner receiving plate comprising a thermoplastic film support and a crosslinked hydrophilic layer thereon, characterized in that said crosslinked hydrophilic layer either carries on top thereof or incorporates spacing particles forming protuberances on said layer.

According to a preferred embodiment, the average particle diameter by volume of the spacing particles is at least twice the average particle diameter by volume of the electrophotographic toner.

16 Claims, 1 Drawing Sheet

METHOD FOR OBTAINING LITOGRAPHIC PRINTING PLATES BY ELECTROPHOTOGRAPHIC IMAGING

FIELD OF THE INVENTION

The present invention relates to lithographic printing plate precursors and more particularly to a method for obtaining lithographic printing plates by electrophotographic imaging.

BACKGROUND OF THE INVENTION

Lithography is the process of printing from specially prepared surfaces some areas of which are capable of accepting lithographic ink, whereas other areas, when moistened with water, will not accept the ink. The areas which accept ink form the printing image areas and the ink-rejecting areas form the background areas.

Generally, two different types of lithographic printing plates prepared by electrophotography have evolved.

One type of printing plate is produced by the following steps: (i) uniformly electrostatically charging a photoconductive layer, such as a coating of zinc oxide photoconductive pigment dispersed in a resin binder, carried on a support by means of a corona-discharge, (ii) image-wise discharging said photoconductive layer by exposing it to electromagnetic radiation to which it is sensitive, (iii) applying electrostatically charged oleophilic resin-containing toner particles to develop the resulting electrostatic charge pattern either by positive or reversal development and (iv) fixing the toner to the photoconductive layer. Fixing is usually accomplished by the use of heat which causes the toner resin powder to coalesce and adhere to the photoconductive layer.

The photoconductive layer with the fused oleophilic image portions is then converted to a lithographic master by treatment with a conversion solution. The conversion step treats the photoconductive coating so that water receptive background areas are obtained. The ink receptive portions are the fused oleophilic toner images.

In another type of printing plate the toner image resulting from step (iii) is transferred from the photoconductive layer to a toner receiving plate on which the toner transfer image is then fixed. In this system the photoconductor can be reused after cleaning. The toner receiving plate does not need a photoconductive coating; any conventional lithographic coating will suffice. Depending on the coating used subsequent chemical treatment may be necessary to render the background areas water receptive.

An example of a toner receiving plate provided with a lithographic coating is described in EP A 405016. Generally high image quality. comprising i.a. high resolution, is set forth as a prerequisite for such lithographic printing plates. However, when such lithographic printing plates are produced according to the second electrophotographic process described above, one of the limiting factors in view of quality of the final printing plate obtained, is the transfer of the toner image from the photoconductive layer to the toner receiving plate.

As is generally known the overall accuracy or fidelity by which an original is reproduced in an electrophotographic process, is to a large extent determined by the characteristics of the toner developer used. This fact being known in itself, there have been several prior art proposals for the manufacture of fine toner particles and in particular for toner particles, having a size distribution which meets a well-defined classification.

In U.S. Pat. No. 3,942,979, U.S. Pat. No. 4,284,701, GB 2,180,948, EP A 0 255 716 and in particular in WO 91/00548 such classified fine developers have been described.

One of the problems encountered with such fine developers, is the reduced efficiency of transferring the fine particle toner-image layer from the photoconductive surface to the image receiving layer, such as a lithographic printing plate precursor.

Such problem is e.g. explicitely recognized in EP-A-354 531 wherein in the third paragraph it is stated that the conventional electrophotographic process works well with large toner particles, but that difficulties arise as the size of the toner particles is reduced. Image defects such as "halo defect", "hollow character" and "dot explosion" arise. Thus, high resolution images require very small particles, but high resolution image free of image defects have not been achievable using electrostatically assisted transfer.

In experiments it also has been noticed that when upon toner receiving plates as described hereinafter, toner images present on the photoconductive drum are transferred in a conventional electrophotographic transfer station, the transfer efficiency decreases substantially when fine toner particles are used, as is required for obtaining high resolution images.

OBJECT OF THE INVENTION

It is now an object of the present invention to provide lithographic printing plates produced in an electrophotographic process comprising transfer of the toner image layer from an image bearing member to the lithographic printing plate precursor, the plates so produced exhibiting high image quality, in particular high image resolution.

It is a further object of the present invention to provide lithographic printing plates whereby the problems set forth above conventionally, occurring during the transfer step in the electrophotographic process are avoided.

Further objects will become apparent from the description hereinafter.

SUMMARY OF THE INVENTION

We now have found that the above cited objects can be met by applying an electrophotographic method of obtaining a lithographic printing plate comprising the step of transferring a toner image from a toner image bearing member to a toner receiving plate, said toner receiving plate comprising a thermoplastic film support and a crosslinked hydrophilic layer thereon, characterized in that said crosslinked hydrophilic layer either carries on top thereof or incorporates spacing particles forming protuberances on said layer.

According to a preferred embodiment, said method further comprises the following steps:

(i) uniformly electrostatically charging a photoconductor element:

(ii) image-wise discharging said photoconductor element:

(iii) developing the resulting electrostatic charge pattern with a dry developer composition, and (iv) electrostatically transferring the developed image to said toner receiving plate.

According to a preferred embodiment said spacing particles have an average particle diameter by volume at least twice the average particle diameter as defined hereinafter of the electrophotographic toner.

Further preferred embodiments will become apparent from the following description.

The present invention further provides a lithographic printing plate precursor comprising a film support and a crosslinked hydrophilic layer thereon, characterized in that the crosslinked hydrophilic layer either carries on top thereof or incorporates spacing particles forming protuberances on said layer.

By applying the method according to the present invention lithographic printing plates of high quality and high resolution are obtained, i.e. lithographic printing plates with excellent lithographic properties that are capable of duplicating runs in the range of several tens of thousands of copies with good screen reproduction and substantially no fog or scumming.

DETAILED DESCRIPTION OF THE INVENTION

Figure 1:
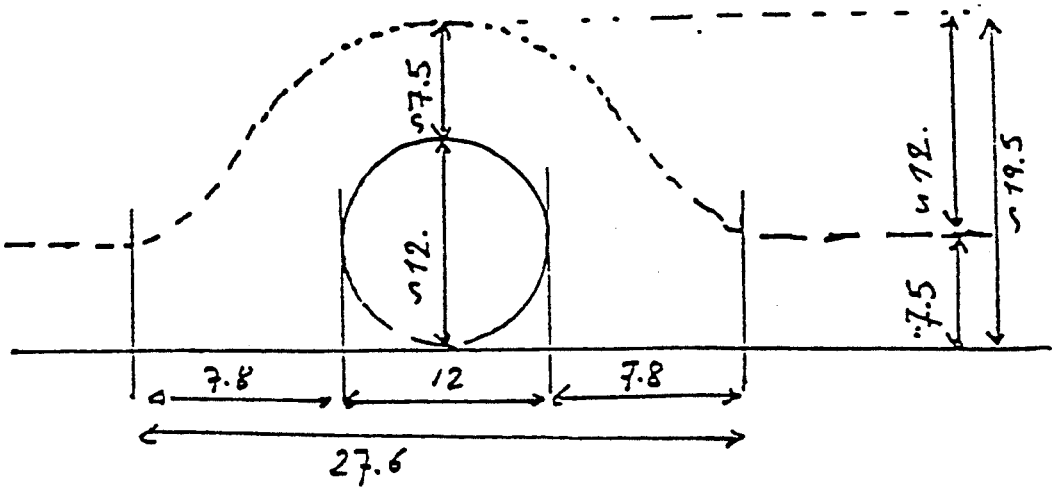

Spacing particles in the toner receiving plates

We have found that, when spacing particles are incorporated into the toner receiving layer as described hereinafter, the efficiency of transferring the toner image from the image bearing member to the lithographic printing plate precursor surprisingly increased noticeably, and the problems described above such as hollow character et al did not occur.

Such spacing particles may be incorporated in the crosslinked hydrophilic layer of the toner receiving plate, thereby forming protuberances on said layer, or they may be provided on top of said crosslinked hydrophilic layer e.g. by coating an additional layer on top of said crosslinked hydrophilic layer, said additional layer comprising such spacing particles.

We further have found that according to a preferred embodiment of our invention, a well-defined relation between the average particle diameter of the toner particles on the one hand and the average particle diameter of the spacing particles on the other hand should be respected.

In the first place in order that the spacing particles should exhibit a 'spacing function' at the critical contact in the electrophotographic transfer station between the photoconductive drum carrying the toner image to be transferred, and the toner receiving layer, said spacing particles should form definite protuberances on said toner receiving layer.

Therefore, taking into account that the thickness of the crosslinked hydrophilic layer is generally comprised within 2–10 micron, said spacing particles should be characterized by an average particle diameter between 10 and 35 micron.

Most preferably, when the thickness of the crosslinked hydrophilic layer is comprised between 4 and 8 micron, said spacing particles should have an average particle diameter between 13 and 25, still more preferably 18 micron.

Apart from the relation between the thickness of the crosslinked hydrophilic layer and the average particle diameter of the spacing particles, we have found that as set forth supra another relation is particularly relevant for the application of the present invention, namely, the relation between the average particle diameter of the spacing particles and the average particle diameter of the toner particles.

According to a preferred embodiment of our invention, we have found that said spacing particles should have an average particle diameter at least twice the average particle diameter of the toner particles.

For obtaining high resolution lithographic printing plates, the toner particles used in the electrophotographic method of our invention should preferably be characterized by a low average particle diameter e.g. less than 10 micron, or a further classified particle size distribution as set forth hereinafter.

The spacing particles further should be characterized by a relatively narrow particle size distribution, and can be made from e.g. hydrophobic starch, an organically modified silica or a resin suitable for making toner particles, as will be described in the examples hereinafter.

A microscopic view of the lithographic printing plate precursor according to the present invention, has revealed that the spacing particles are mostly fully incorporated in the hydrophilic layer itself and that the uneveness or roughness degree of the surface of said plate consequently corresponds to the particle diameter of said spacing particles. This is illustrated in FIG. 1, in which A represents the toner receiving layer support of thermoplastic material, B represents the hydrophilic layer and C represents the spacing particle as embedded in the hydrophilic layer, the hydrophilic layer having in this case a thickness of 7.5 micron, and the spacing particles having a diameter of 12 microns. As is clear from this figure the difference in thickness of the overall lithographic printing plate precursor, corresponding to the apparent height of the protuberances in said plate caused by said spacing particles, corresponds to the diameter of said spacing particles. As is also apparent from said figure the actual diameter of said protuberances is substantially larger that the diameter of the spacing particle in se. the latter phenomenon contributing substantially to the increase in transfer efficiency caused by the presence of said spacing particles. In effect, the radius of the protuberances is roughly equal to the diameter of the spacing particles.

As the typical thickness of the image formed by the toner particles transferred from the toner image bearing member, e.g. a photoconductive element, to the lithographic printing plate precursor, amounts to approximately twice the average diameter of the toner particles, it results that the beneficial effect on the transfer efficiency of the electrophotographic process in particular is noted if the average diameter of the spacing particles is at least twice the average diameter of the toner particles. For easy and steady state or consistent operation, the ratio between the average particle diameter of the spacing articles and the average particle diameter of the toner particles should preferably be somewhat higher e.g. be situated between 2.2 and 2.8.

According to the most preferred embodiment of our invention, apart from said ratio, the spacing particles and the toner particles should each be characterized by a narrow size distribution.

Toner receiving plate

The toner receiving plate of the present invention comprises a plastic film support and a crosslinked hydrophilic layer thereon.

The hydrophilic layer contains a hydrophilic (co)polymer or (co)polymer mixture crosslinked by means of a crosslinking agent.

As hydrophilic (co)polymers may be used, for example, homopolymers and copolymers of vinyl alcohol acrylamide methylol acrylamide, methylol methacrylate, acrylic acid, methacrylic acid, hydroxyethyl acrylate, hydroxyethyl methacrylate or maleic anhydride/-vinylmethylether copolymers. The hydrophilicity of the (co)polymer or (co)polymer mixture used is the same as or higher than the hydrophilicity of polyvinyl acetate hydrolyzed to at least an extent of 60 percent by weight, preferably 80 percent by weight.

Examples of crosslinking agents for use to crosslink the hydrophilic layer are hydrolyzed tetramethyl orthosilicate, hydrolyzed tetraethyl orthosilicate, diisocyanates, bisepoxides, melamine formol and methylol ureum, as well as titanate and zirconate compounds.

The coating is preferably pigmented with titanium dioxide of pigment size which typically has an average mean diameter in the range of about 0.1 microns to 1 micron. Apparently, the titanium dioxide may even react with the other constituents of the layer to form an interlocking network forming a very durable printing plate. The titanium dioxide may be coated with for example aluminium oxide. Other pigments which may be used instead of or together with titanium dioxide include silica or alumina particles. barium sulfate magnesium titanate etc. and mixtures thereof. By incorporating these particles in the crosslinked hydrophilic layer of the present invention the mechanical strength of the layer is increased and the surface of the layer is given a uniform rough texture consisting of microscopic hills and valleys, which serve as storage places for water in background areas.

Preferably, the crosslinked hydrophilic layer of the present invention comprises a hydrophilic, homogeneous reaction product of polyvinyl alcohol, hydrolyzed tetra(m)ethyl orthosilicate and titanium dioxide.

The amount of crosslinking agent is at least 0.2 parts by weight per part by weight of hydrophilic (co)-polymer, preferably between 0.5 and 2 parts by weight, most preferably 1 part by weight. The pigment is incorporated in an amount of between 1 and 10 parts by weight per part by weight of hydrophilic (co)polymer.

According to a preferred embodiment of the toner receiving layer, the coating composition for the toner receiving plate is prepared by mixing together a dispersion of titanium dioxide in hydrolised polyvinyl acetate, preferably the acetate marketed by Wacker Chemie GmbH, F. R. Germany, under the trade mark MOWIOL W4820, and a dispersion of carbon black in hydrolised polyvinyl acetate and by adding to the resulting dispersion hydrolyzed tetra(m)ethyl orthosilicate. The amount of hydrolyzed tetra(m)ethyl orthosilicate in the coating composition is an amount corresponding to between 5 and 60%, preferably between 15 and 30% by weight of tetra(m)ethyl orthosilicate based on $TiO_2$, the amount of polyvinyl alcohol is between 10 and 50%, preferably between 15 and 30% by weight based on $TiO_2$ and the amount of carbon black is between 1 and 10%. preferably about 4% by weight based on the amount of titanium dioxide. Preferably some wetting agents are added to the coating composition.

In order to obtain stable dispersions the type of carbon black that is used (acid or basic carbon black) should preferably be "tuned" or matched to the type of $TiO_2$ used in combination with the pH of the layer. The dispersing agent that is used should preferably also be properly selected in this respect. For more particulars reference is made to EP 405016.

The above described crosslinked hydrophilic background layer has the desired hardness and degree of affinity for water to provide a long running lithographic printing plate with excellent toner adhesion and plate durability.

The coating composition of the toner receiving plate is coated on a plastic film support using any conventional coating method. A plastic film support. e.g. a polyester such as a polyethylene terephthalate, a polycarbonate a polyphenylenesulfide or a polyetherketone support, has the advantage compared to a paper or polyethylene coated paper support that it does not tear that easily that it is stronger and that it has a high dimensional stability.

Coating is preferably carried out at a temperature in the range of 30 to 38° C. preferably at 36° C. The thickness of the crosslinked hydrophilic layer in the toner receiving plate of the present invention may vary in the range of 0.1 to 10 microns and is preferably 4 to 7 microns.

The plastic film support may be coated with a subbing layer to improve the adherence of the lithographic coating thereto. Between the support, whether or not subbed, and the hydrophilic crosslinked layer there may be provided a layer containing boric acid to advance the gelation of the polyvinyl acetate matrix.

Electrophotographic process

The basic electrophotographic process steps of the present invention, i.e. charging, discharging, developing, transferring, fixing and the subsequent cleaning of the photoconductor are carried out according to techniques known in the art, as described, for example, in "Electrophotography" written by R. M. Schaffert and published by The Focal Press, London, Enlarged and Revised Edition, 1975.

Since the practice of electrophotography is well known to those skilled in the art, the various processing stations of an electrophotographic apparatus suitable for applying the method of our invention will not be described in detail. An electrophotographic apparatus suitable for applying the method of our invention is described e.g. in EP-A-0131070.

Transfer of toner image

After development the toner image is electrostatically transferred to a toner receiving plate to give the lithographic printing plate precursor. This transfer is effected by placing the toner receiving plate in contact with the developed toner image on the photoconductor, charging the plate electrically with the same polarity as that of the latent image and then stripping the plate from the photoconductor. The charge applied to the plate overcomes the attraction of the latent image for the toner particles and pulls them onto the plate.

Fusing of the transferred toner image to the toner receiving plate

An important step in the lithographic printing plate making method of the present invention is the fusing of the transferred toner image to the surface of the toner receiving plate so that it is strongly bonded thereto and will withstand the rigours of the lithographic printing process thereby producing a long running printing plate.

It has been found that for the method according to the present invention the fusing method by excellence is infrared radiation fusing.

In the hot roller fusing method, which is commonly used in electrophotographic techniques, the support with the toner image is simultaneously pressed and heated between a fuser roller and a pressure exerting roller. In order to prevent toner offset on the fuser roller the fuser roller is wetted with silicone oil.

Silicone oil renders the whole surface of the printing plate hydrophobe. This hydrophobic contamination of the printing plate surface will induce scumming. i.e. ink during the printing process in the non-image (i.e. non-toned) areas. Moreover toner fog, i.e. spurious microscopic toner particles which are deposited in the non-image areas, is intensified due to the simultaneous heating and pressing of the toner particles onto the surface of the plate. Therefore, when hot roller fusing, although nowadays the preferred fusing method in common electrophotographic techniques, would be used in the electrophotographic production method of printing plates, an optimal quality would not be obtained.

In infrared radiation fusing on the contrary the black image areas are selectively fused leaving unfused the spurious microscopic toner particles which are deposited in the non-image areas due to the fact that these spurious toner particles dissipate the radiation heat so quickly that they do not fuse. The unfused particles at the end of the process usually fall off and do not appear on the lithographic plate. This phenomenon together with the fact that infrared radiation is a contactless fusing method leads to a decrease in toner fog which benefits the quality of the printing plate.

It is advantageous to incorporate infrared absorbing materials into the hydrophilic coating particular about such materials are described in the already cited EP 405016.

As a typical infrared radiation fusing arrangement, the toner imaged surface is passed beneath an infrared radiator. The radiator attains a filament temperature in the range of 2000° to 3000° C. The radiator may be provided with a reflective coating or a reflective coating may be provided around the lamp. The irradiating temperature may be adjusted through variation of the power to the infrared radiator. At the rear side of the plate another infrared radiator or another heating element may be provided. Experiments have shown that to obtain the high running length benefits the surface of the plate should preferably be brought to a temperature above 140° C. by irradiating for ½ to 1 second.

After the toner image has been fixed to the toner receiving plate of the present invention the plate is ready for printing. The oleophilic toner image areas form the ink receptive portions and the non-toned hydrophilic background areas form the water receptive portions. Generally, no further processing or development is required to effect this differential hydrophilic-hydrophobic characteristic.

The toner imaged plate mounted on a printing press, inked with a conventional lithographic greasy or fatty ink in the areas containing fixed toner and wetted with a conventional lithographic aqueous damping liquid in the still bare hydrophilic layer parts, yields several thousands of good-quality copies.

Thermostable film support

When no precautionary measures are taken the plastic film support of the toner receiving plate may irreversibly shrink when brought at temperatures above 140° C. in the infrared fusing station according to the preferred mode of our invention. In addition to shrinking the plate may be deformed such that mounting on a printing press becomes difficult. Since one wants to obtain a true, faithful reproduction of the original to be copied, dimensional instability is detrimental to the quality of the copy and has to be avoided.

Therefore preferably a thermostable plastic film support is used.

Thermostable film supports and in particular thermostable polyethylene terephthalate film supports for use in the present invention are obtained by heat-relaxing biaxially oriented polyethylene terephthalate film whereby internal stresses in the biaxially oriented film are allowed to relax.

The polyethylene terephthalate film to be heat-relaxed has been previously biaxially stretched and heat-set to achieve enhanced crystallinity. The techniques and principles employed to biaxially stretch and heat-set polyesters are well known. In general, stretching is carried out when the film is heated to temperatures above the glass transition temperature but below the melting temperature of the polymer. The heated film is stretched longitudinally and subsequently transversely. To enhance the crystallinity and to increase the dimensional stability of the stretched film, it is heat-set by heating it above its glass transition temperature but below its melting temperature (usually between 150° and 230° C.) while maintaining its length and width dimensions constant.

Biaxially oriented polyester films, although heat-set will shrink if later employed at high temperatures. This can be avoided by heat-relaxing or preshrinking the film at temperatures above the temperature at which the film will be used later on and by simultaneously allowing the film to shrink (relax) in both dimensions. Heat-relaxing devices are described in e.g. U.S. Pat. No. 2,779,684, U.S. Pat. No. 4,160,799 and U.S. Pat. No. 3,632,726 and in references cited therein.

Heat-relaxed biaxially oriented polyethylene terephthalate film exhibits a high degree of dimensional stability and resistance to shrinkage at elevated temperatures up to the heat-relaxing temperature.

Developer Compositions

Various kinds of dry developers may be used for applying the present invention. Developers suitable for use in our invention are either two-component or mono-component developer compositions. The toner generally comprise a resin binder a colorant and one or more additives such as a charge control agent and a flow enhancing agent.

Resins

Illustrative examples of toner resins include numerous known suitable resins such as polyesters polymers of styrene/butadiene, styrene/methacrylate, styrene and acrylate, polyamides, epoxies, polyurethanes and vinyl resins. Suitable vinyl resins include homopolymers or copolymers of two or more vinyl monomers. Particularly suitable vinylic resins as well as their mode of preparation may be found in EP-A-0380813. A particularly suitable polyester resin is ATLAC T500 (trade name of Atlas Chemical Industries Inc., Wilmington, Del. USA) being a propoxylated bisphenol A fumarate polyester and discussed more in detail in WO 91/00548.

Charge control agent

To enhance the chargeability in either negative or positive direction of the toner particles (a) charge control agent(s) is (are) added to the toner particle composition as described e.g. in the published German patent application (DE-OS) 3,022,333 for yielding negatively chargeable toner particles or as described e.g. in the published German Patent application (DE-OS) 2,362,410 and the U.S. Pat. Nos. 4,263,389 and 4,264,702 for yielding positively chargeable toner particles. A very useful charge control agent for offering positive charge polarity is BONTRON N04 (trade name of Oriental Chemical Industries Japan) being a resin acid modified nigrosine dye which may be used e.g. in an amount up to 5% by weight with respect to the toner particle composition. A very useful charge control agent for offering negative charge polarity is BONTRON S36 (trade name of Oriental Chemical Industries - Japan) being a metal complex dye which may be used e.g. in an amount up to 5% by weight with respect to the toner particle composition.

Pigments

Further, the toner material should comprise a colorant, which may be a dye or pigment soluble or dispersable in the polymeric binder.

In order to obtain toner particles with sufficient optical density in the spectral absorption region of the colorant the colorant is used preferably in an amount of at least 2% by weight with respect to the total toner composition more preferably in an amount of 5 to 15% by weight.

For black toners preference is given to carbon black as a colorant.

Examples of carbon black and analogous forms therefore are lamp black, channel black, and furnace black e.g. SPEZIALSCHWARZ IV (trade-name of Degussa Frankfurt/M, W. Germany) and VULCAN XC 72 and CABOT REGAL 400 (trade-names of Cabot Corp. High Street 125, Boston, U.S.A.).

Toners for the production of colour images may contain organic dyes or pigments of the group of phthalocyanine dyes, quinacridone dyes, triaryl methane dyes, sulphur dyes, acridine dyes, azo dyes and fluoresceine dyes. A review of these dyes can be found in Organic Chemistry by Paul Karrer, Elsevier Publishing Company, Inc. New York (1950).

Typical inorganic pigments include black iron(III) oxide, copper(II) oxide and chromium(III) oxide powder, milori blue, ultramarine cobaltblue and barium permanganate.

In order to obtain toner particles having magnetic properties a magnetic or magnetizable material may be added during the toner production.

Toner preparation

As is said forth supra, the size and size distribution of the toner particles employed is one of the principal contributing characteristics for obtaining high fidelity in electrophotographic reproduction.

In view hereof particularly classified toner particles are preferentially used in the present invention.

Such classified toner particles may be prepared according to one of the techniques described in the patent specifications cited above, and in particular in WO 91/00548, the contents whereof are incorporated herein by reference.

The toner compositions suitable for use in accordance with the present invention should be prepared by selecting and modifying some of the known toner mixing and comminution techniques. As is generally known toner is prepared by subsequently blending and mixing the components in the molten state and after cooling, milling and micropulverizing the resulting mixture. Thereafter so as to obtain toner particles corresponding to predetermined particle-sizes, a suitable particle classification method is employed. Typical particle classification methods include air classification, screening, cyclone separation, elutriation, centrifugation and combinations thereof.

The preferred method of obtaining fine toner particles of our invention is by centrifugal air classification.

Suitable milling and air classification results may be obtained when employing a combination apparatus such as the A.F.G. (Alpine Fliessbeth-Gegenstrahlmühle) type 100 as milling means, equipped with an A.T.P. (Alpine Turboplex windsichter) type 50 G.S., as air classification means, the model being available from Alpine Process Technology Ltd., Rivington Road, Whitehouse, Industrial Estate, Runcorn, Cheshire, U.K. Further air classification can be realized using an A 100 MZR (Alpine Multiplex Labor Zick-zack sichter) as additional classification apparatus, the latter model being also available from Alpine Process Technology Ltd. The size distribution of the so obtained toner particles can be determined in a conventional manner by employing a Coulter Counter type TA II/P-CA1, model available from the Coulter Electronics Corp., Northwell Drive, Luton, Bedfordshire, LV 33 R4, United Kingdom.

In the air classification apparatus, air or some other gas is used as transport medium and particles contained in the fluidum are exposed to two antagonistic forces, viz., to the inwardly directed tractive force of the fluidum, and to the outwardly directed centrifugal force of the particle. For a definite size of particles, that is, the "cut size" both forces are in equilibrium. Larger (heavier) particles are dominated by the mass-dependent centrifugal force and the smaller (lighter) particles by the frictional force proportional to the particle diameter. Consequently, the larger or heavier particles fly outwards as coarse fraction, while the smaller or lighter ones are carried inwards by the air as fine fraction. The "cut size" usually depends upon the geometrical as well as operational parameters (dimensions of classification, rotor, rotational velocity, etc.). Adjustment of the cut size may be effected through variation of the above mentioned parameters.

Particularly suitable for the application of the present invention are toner particles that feature a classified size distribution wherein the average equivalent particle diameter by volume hereinafter in short referred to as 'average particle diameter' of the electrophotographic toner composition is less than 10 micron.

According to a further preferred embodiment more than 90% of the electrophotographic toner particles have an average particle diameter between 0.5 and 10 microns.,still more preferably between 0.5 and 8 microns and wherein more than 50% have an average particle diameter less than 6 microns. According to the best mode, more than 90% of the electrophotographic toner composition have an average particle diameter between 0.5 and 7 microns and more than 50% have an average particle diameter less than 5 microns.

Although by application of the mentioned preparation methods toner particles may be prepared which are in accordance with the aforementioned size distribution, these toner particles as such may exhibit problems when used in an electrostatographic apparatus for application of the method of our invention as their flowability and hence forth overall performance in the electrostatographic process is insufficient.

Flow improving agents

By adding suitable flow improving agents in a selected way, the flowability of toner particles prepared as described above can be sufficiently enhanced so as to obtain toner particles which preferentially are suited for use in our invention.

The flow improving additives mostly are extremely fine inorganic or organic materials. Widely used in this context are fumed inorganics such as silica, alumina or zirconium oxide or titanium oxide. The use of silica as flow improving agent for toner compositions is described in the United Kingdom Patent Specification No. 1,438,110.

The fumed silica particles have a smooth, substantially spherical surface and preferably they are coated with a hydrophobic layer such as obtained by methylation. Their specific surface area is preferably in the range of 100 to 400 sq.m/g.

Fumed silica particles are commercially available under the Trade Marks AEROSIL and CAB O.SIL marketed by Degussa, Frankfurt (M), W. Germany and Cabot Corp. Oxides Division, Boston, Mass., U.S.A. respectively. AEROSIL R972 is a fumed hydrophobic silica having a specific surface area of 110 sq.m/g. The specific surface area can be measured by a method described by Nelsen and Eggertsen in "Determination of Surface Area Adsorption Measurements by continuous Flow Method", Analytical Chemistry, Vol. 30, No. 8 (1958) 1387-1390.

The preferred proportions of fumed silica to toner material are in the range of 0.5 to 3% by weight.

In addition to fumed silica, a metal soap e.g. zinc stearate as described e.g. in the United Kingdom Patent Specification No. 1,379,252, may also be used as additional flow improving agent. Other flow improving additives are based on fluoro-containing polymer particles of sub-micron size.

The preferred proportions of metal soap such as zinc stearate to toner material are in the range of 0.05 to 1% by weight. The same holds for F-containing particles.

Particularly preferred flow improving microparticles are the fluorinated silica-type microparticles as described in EP-A-90113845.3.

In said specification a fluorinated aerosil is obtained by reaction between a fumed silica and $C_4F_9(CH_2)_2Si(OCH_3)_3$.

The so obtained fluorinated aerosil is particularly useful as flow improving additive for toners used in the application of the present invention.

Carriers

In case a two-component colored developer composition is used, the toner composition should be used in combination with carrier particles.

Useful carrier materials for cascade development include sodium chloride, ammonium chloride, aluminium potassium chloride, Rochelle salt, sodium nitrate, aluminium nitrate, potassium chlorate, granular zircon, granular silicon, silica, methyl methacrylate, glass. Useful carrier materials for magnetic brush development include, steel, nickel, iron, ferrites, ferromagnetic materials, e.g. magnetite, whether or not coated with a polymer skin. Other suitable carrier particles include magnetic or magnetizable materials dispersed in powder form in a binder as described e.g. in U.S. Pat. No. 4,600,675. Many of the foregoing and typical carriers are disclosed in U.S. Pat. Nos. 2,618,441; 2,638,416; 2,618,522; 3,591,503 and 3,533,835 directed to electrically conductive carrier coatings, and U.S. Pat. No. 3,526,533 directed to polymer coated carriers. Oxide coated iron powder carrier particles are described e.g. in U.S. Pat. No. 3,767,477. The U.S. Pat. Nos. 3,847,604 and 3,767,578 relate to carrier beads on the basis of nickel. An ultimate coated carrier particle diameter between about 30 microns to about 1000 microns is preferred. The carrier particles possess then sufficient inertia to avoid adherence to the electrostatic images during the cascade development process and withstand loss by centrifugal forces operating in magnetic brush development. The carrier may be employed with the toner composition in any suitable combination, generally satisfactory results have been obtained when about 1 part of toner is used with about 5 to about 200 parts by weight of carrier.

The carrier particles may be electrically conductive, insulating, magnetic or non-magnetic (for magnetic brush development they must be magnetic), as long as the carrier particles are capable of triboelectrically obtaining a charge of opposite polarity to that of the toner particles so that the toner particles adhere to and surround the carrier particles.

In developing an electrostatic image to form a positive reproduction of an original, the carrier particle composition and/or toner particle composition is selected so that the toner particles acquire a charge having a polarity opposite to that of the electrostatic latent image so that toner deposition occurs in the charged areas of the photoconductive drum. Alternatively, in reversal reproduction of an electrostatic latent image, the carrier particle composition and toner particle composition is selected so that the toner particles acquire a charge having the same polarity as that of the electrostatic latent image resulting in toner deposition in the non-charged areas of the photoconductive drum.

Our invention will now be further illustrated by means of examples.

EXAMPLES

Preparation of toner receiving plates

A toner receiving plate $R_1$ (comparison) was prepared as described in EP-A-89201696 by coating on a subbed, 125 microns thick polyethylene terephthalate film that was heat-relaxed at 180° C. in order to be thermostable to 160° C. a composition containing the following ingredients: 2100 g of $TiO_2$ dispersion, 580 ml of water, 500 ml of hydrolised TMOS, 200 g of carbon black dispersion, wetting agents and sodium hydroxide in an amount to obtain a pH value of 4. The wet thickness of the layer was 55 microns. The $TiO_2$ dispersion, the carbon black dispersion, and the hydrolysed tetramethyl ortho silicate (TMOS) were prepared according to the procedure set forth in the already cited EP-A-89201696.

A toner receiving plate $R_2$ was prepared analogously to $R_1$ with the exception that a dispersion of 25 g of ORYFLO, being a hydrophobic starch made out of maize, having an average particle diameter by volume of 13 microns, available from Roquette National Chimie, Rue Patou 4, F-59022, Lille-Cedex, France, in 50 ml of ethanol, was added to the above-mentioned coating composition. As a result the plate $R_2$ comprised 500 mg of DRYFLO-particles per sq.m, acting as spacing agents on said toner receiving plate.

A toner receiving plate $R_3$ was prepared analogously to $R_2$ with the exception that such an amount of the hydrophobic starch dispersion was added that as a result the plate $R_3$ comprised 200 mg of DRYFLO particles per sq.m.

A toner receiving plate $R_4$ was prepared carrying a hydrophobic starch dispersion on top of the crosslinked hydrophilic layer. Therefore a composition comprising 5 g of DRYFLO. as described above. in 25 ml of ethanol, 50 ml of hydrolised polyvinyl acetate (being the product marketed under the trade name MOWIOL, as described above), 263 ml water and 15 ml of wetting agents, in total 358 ml, was manually coated on the toner receiving plate $R_1$, resulting in a wet top layer of approximately 36 microns.

A toner receiving plate $R_5$ was prepared analogously to $R_4$ with the exception that a dispersion in ethanol of Bentone SD-1 an easily dispersable rheological additive on the basis of organically modified silica having an average particle diameter by volume of 18 microns, available from NL Chemicals, S.A./N.V. - Kronos, Gasthuisstraat 31, bus 6, Brussels, Belgium, was manually coated on top of the crosslinked hydrophilic layer of the toner receiving plate $R_1$.

A toner receiving plate $R_6$ was prepared analogously to $R_1$ with the exception that spacing particles having an average particle diameter by volume of 13 microns and by number of 10 microns, prepared according to the procedure set forth hereinafter, were added to the abovementioned coating composition in such amount that the resulting plate contained 1 g of such spacing particles per sq.m.

The spacing particles consist of ATLAC T500 as Dase resin. aforementioned, and 10% Cabot Regal 400 as carbon black, aforementioned, and were prepared via conventional toner preparation techniques as melthomogenisation followed by subsequent milling and sieving using the A.F.G.-apparatus described supra.

A toner receiving plate $R_7$ was prepared analogously to $R_6$ with the exception that the milling and seiving steps in the manufacture of the spacing particles were performed such that the resulting spacing particles were characterized by an average particle diameter by volume of 18 microns and by number of 15 microns.

A toner receiving plate $R_8$ was prepared analogously to $R_6$ with the exception that the milling and seiving steps in the manufacture of the spacing particles were performed such that the resulting spacing particles were characterized by an average particle diameter by volume of 35 microns and by number of 25 microns.

Toner preparation A 90 parts of ATLAC T500 (trade name of Atlas Chemical Industries Inc., Wilmington, Del. USA) being a propoxylated bisphenol A fumarate polyester with a glass transition temperature of 51° C., a melting point in the range of 65° to 85° C., an acid number of 13.9, and an intrinsic viscosity measured at 25° C. in a mixture of phenol/ortho dichlorobenzene (60/40 by weight) of 0.175, and 10 parts of Cabot Regal 400 (trade name of Cabot Corp., Boston, Mass., USA) being a carbon black, were introduced in a kneader and heated at 120° C. to form a melt, upon which the kneading process was started. After about 30 minutes the kneading was stopped and the mixture was allowed to cool to room temperature (20° C.). At that temperature the mixture was crushed and milled to form a powder, which was further reduced in grain size by jet milling. Further, air classification using a combination apparatus such as the A.F.G. (Alpine Fliessbeth-Gegenstrahlmühle) type 100 as milling means, equipped with an A.T.P. (Alpine Turboplex windsichter) type 50 G.S., as air classification means the model being available from Alpine Process Technology Ltd., Rivington Road, Whitehouse, Industrial Estate, Runcorn, Cheshire, U.K. Further air classification was realized using an A 100 MZR (Alpine Multiplex Labor Zick-zack sichter) as additional classification apparatus, the latter model being also available from Alpine Process Technology Ltd. The size distribution of the so obtained toner particles was determined in a conventional manner by employing a Coulter Counter type TA II/PACAI, model available from the Coulter Electronics Corp., Northwell Drive, Luton, Bedfordshire, LV 33 R4, United Kingdom.

The average particle diameter by volume measured in the aforementioned Coulter Counter apparatus was 8.5 micron, and the average particle diameter by number was 6.5 micron.

Addition of microparticles

The toner particles, the preparation of which is described hereinabove, were introduced in a mixing apparatus according to the procedure as described hereinafter and inorganic microparticles were admixed to the toner particles.

The microparticles were modified fumed silica as prepared by flame hydrolysis and with a specific BET-surface of 180 $m^2/g$. The fumed silica had been modified with the following compound:

$C_4F_9(CH_2)_2Si(OCH_3)_3$

The method of adding the modified Aerosil to the toner particles was as follows: 100 g of toner and 0.7 g of Aerosil were fed to a Janke and Kunkel labor-mill apparatus type IKA M20, rotating at a speed of 20,000 rpm, and thermostabilised at 20° C. (model available from the Janke and Kunde GmbH. IKA Labortechnik, D-7813 Staufen, W. Germany). Mixing time: 15 sec.

Developer composition A

A developer composition for use in a two-component electrostatographic process was prepared as follows: after addition of the toner/microparticles mixture set forth above to an ordinary Zn-Ni-ferrite carrier (with an average particle diameter of 70 microns) in an amount of 2.5% by weight with respect to the carrier the developer was activated by rolling in a metal box with a diameter of 6 cm, at 300 revolutions per minute, during a period of 30 minutes, with an apparent degree of filling of 30%.

Toner preparation B

A toner composition was prepared analogously to the toner preparation A with the exception that the crushing, milling and air classification operations were performed such that a toner with an average particle diameter by volume of 5 micron resulted (the average particle diameter by number was 4 micron).

Developer composition B

To the toner prepared according to the procedure just mentioned, microparticles were added analogously as to the addition of microparticles to toner preparation A, with the exception that 1 g of the fluorinated Aerosil were fed to 100 g of toner. Hereupon a developer composition B was prepared analogously to the procedure for developer composition A with the exception that the amount of toner according to preparation B was 3.5% by weight with respect to the Zn-Ni-ferrite carrier.

Development and transfer

An electrostatic image formed on an electrophotographic recording element, i.e. an $As_2Se_3$ coated conductive drum, which was positively charged by means of a corona-grid discharge and imagewise exposed in an optical scanning apparatus with a moving original and a fixed 305 mm lens, was developed by a magnetic brush using the developer A resp. B.

The transfer of the electrostatically deposited toner proceeded by applying a positive voltage of 7 kV to a DC transfer corona, which was kept in close contact with the rear side of the toner receiving plate whose front side was therefore kept in close contact with the toner image on the photoconductor. An AC corona discharge was applied to the back of the receiving plate immediately following the application of the DC transfer corona to facilitate removing the receiving plate with the transferred toner image from the photoconductor surface.

Fixation

The toner imaged plate was fed to a fusing device operating with an infrared radiator provided with a reflective coating. At the rear side of the receiving plate a heating plate was provided. The infrared radiator was located at a distance of 10 mm from the toner imaged plate surface which was caused to move past the radiator at a rate of 5 cm/s.

The heating plate was brought to a temperature of 125° C. A power of 550 W was applied to the infrared radiator corresponding to a temperature of about 2600 K. The plate was irradiated for about ½ to 1 second.

Evaluation of transfer efficiency and subsequent copy quality

In table 1 the experimental results are set forth with respect to the efficiency of the transfer of the toner image on the photoconductor to the various toner receiving plates, for developer composition A. resp. B.

TABLE 1

| Toner receiving plate | Average diameter of spacing agents | Transfer Efficiency with | |
|---|---|---|---|
| | | Dev. comp. A | Dev. comp. B |
| $R_1$ | — | − | − |
| $R_2$ | 13 | − | + |
| $R_3$ | 13 | − | + |
| $R_4$ | 13 | − | + |
| $R_5$ | 18 | + | + |
| $R_6$ | 13 | | + |
| $R_7$ | 18 | | + |
| $R_8$ | 35 | | + |

In the above table 1:
column 2 indicates the average diameter by volume of the spacing particles, expressed in micron, present either on top of the crosslinked hydrophilic layer, or incorporated therein;
columns 3 and 4 indicate whether the transfer of the toner image on the photoconductive drum to the toner receiving plate occurred efficiently and problemfree (+) or whether various problems occurred thereby (−), such as insufficient transfer as a whole, partial transfer of full-black areas (hollow character), loss of resolution, etc.

From the above table it clearly results that a definite correlation between the average diameter of the spacing particles on or in the toner receiving plate and the average diameter of the developer composition exists.

Taking into account that twice the average diameter of the toner composition A amounts to 17 micron, and twice the average diameter of the toner composition B amounts to 10 micron, it is apparent from the above table, that an efficient electrophotographic transfer from the photoconductive drum to the toner receiving plate occurs on the condition that the average diameter of the spacing particles is greater than twice the average diameter of the toner composition used.

Lithographic printing plates, being toner receiving plates whereupon toned images were efficiently transferred according to the above-described procedure for subsequent fixation in an infrared fusing station, were mounted on a lithographic printing press and used for printing with a conventional fountain solution and lithographic ink. For each of the toner receiving plates about 20,000 reproductions of good quality were obtained.

We claim:

1. In an electrophotographic method for obtaining a lithographic printing plate which includes the step of transferring a toner image from a toner image bearing member to a toner receiving plate to produce a precursor form of said lithographic printing plate, the improvement wherein said toner receiving plate comprises a thermoplastic film support and a crosslinked hydrophilic layer thereon, and said hydrophilic layer has projecting from substantially the entirety of the exposed surface thereof discrete minute protuberances.

2. The electrophotographic method according to claim 1 wherein said toner image bearing member is formed by the steps comprising:

(i) uniformly electrostatically charging a photoconductor element;

(ii) image-wise discharging said photoconductor element, (iii) developing the resulting electrostatic charge pattern with a dry toner particles; and (iv) electrostatically transferring the thus toner developed image from the photoconductor element.

3. Electrophotographic method of claim 1 wherein said spacing particles have an average particle diameter at least twice the average particle diameter of said toner particles.

4. Electrophotographic method of claim 1 wherein said spacing particles are incorporated in the crosslinked hydrophilic layer, thereby forming protuberances on said layer, said crosslinked hydrophilic layer has a thickness between 2 and 10 micron and said spacing particles have an average particle diameter between 10 and 35 micron.

5. Electrophotographic method of claim 4 wherein said crosslinked hydrophilic layer has a thickness between 4 and 8 micron, and said spacing particles have an average particle diameter between 13 and 18 micron.

6. Electrophotographic method according to claim 1 wherein the average particle diameter of said toner particles is less than 10 micron.

7. Electrophotographic method according to claim 6 wherein of said toner particles more than 90% have an average particle diameter between 0.5 and 8 microns.

8. Lithographic printing plate precursor comprising a thermoplastic film support, and a crosslinked hydrophilic layer thereon, the crosslinked hydrophilic layer having projecting from substantially the entirety of the exposed surface thereof discrete minute protuberances.

9. Lithographic printing plate precursor according to claim 8, wherein said spacing particles are incorporated in the crosslinked hydrophilic layer, thereby forming said protuberances on said layer, and that said crosslinked hydrophilic layer has a thickness between 2 and 10 micron whereby said spacing particles have an average particle diameter between 10 and 35 micron.

10. Lithographic printing plate precursor according to claim 8, wherein said crosslinked hydrophilic layer has a thickness between 4 and 8 micron, and said spacing particles have an average particle diameter between 13 and 18 micron.

11. The method of claim 1 wherein said protuberances are constituted by spacing particles adhered to the surface of or incorporated in said crosslinked hydrophilic layer.

12. The method of claim 1 wherein said spacing particles have an average diameter which falls within a narrow particles size distribution.

13. The method of claim 12 wherein more than 90% of said spacing particles have an average diameter between 0.5 and 10 microns and more than 50% have an average diameter of less than 6 microns.

14. The lithographic printing plate precursor according to claim 8 wherein said protuberances are formed by spacing particles either adhered to the surface of or incorporated in said crosslinked hydrophilic layer.

15. The plate precursor of claim 14 wherein said spacing particles have an average diameter which falls within a narrow particle size distribution.

16. The plate precursor of claim 14 wherein more than 90% of said spacing particles have an average diameter between 0.5 and 10 microns and more than 50% have an average diameter of less than 6 microns.

* * * * *